United States Patent [19]

Schleusener

[11] Patent Number: 4,880,430

[45] Date of Patent: Nov. 14, 1989

[54] MIXTURES OF AN ACYLATED POLYAMINE AND AN ALCOHOL-ETHER USEFUL FOR TEXTILE FINISHING

[75] Inventor: Eckart Schleusener, Reinach, Switzerland

[73] Assignee: Sandoz Ltd., Basel, Switzerland

[21] Appl. No.: 175,566

[22] Filed: Mar. 31, 1988

[30] Foreign Application Priority Data

Apr. 4, 1987 [DE] Fed. Rep. of Germany ..... 3711440

[51] Int. Cl.[4] ..... D06M 13/40; D06M 15/61

[52] U.S. Cl. ..... 8/188; 8/115.6; 8/115.7; 8/181; 8/196; 252/8.8; 252/8.9

[58] Field of Search ..... 8/188, 196; 252/8.8, 252/8.9

[56] References Cited

FOREIGN PATENT DOCUMENTS

| | | |
|---|---|---|
| 38862 | 11/1981 | European Pat. Off. . |
| 1269090 | 5/1968 | Fed. Rep. of Germany . |
| 1769525 | 10/1971 | Fed. Rep. of Germany . |
| 134675 | 3/1972 | Netherlands . |
| 2168374 | 1/1986 | United Kingdom . |

*Primary Examiner*—A. Lionel Clingman

*Attorney, Agent, or Firm*—Gerald D. Sharkin; Richard E. Vila; Thomas C. Doyle

[57] ABSTRACT

Water-dilutable compositions consisting essentially of (a) an acylated polyamine derivative selected from the group consisting of:

1. a polyamine acylated by introduction of at least one radical of a $C_{12-24}$-fatty acid and oxyalkylated,
2. an alkylated derivative of 1.,
3. a quaternated derivative of 1 or 2,
4. a protonated derivative of 1., 2. or 3., or a mixture thereof and (b) an alcohol-ether of the average formula $$R—O—(CH_2—CH_2—O)_nH \quad (I),$$

wherein R is $C_{1-4}$-alkyl
and n is a number from 3 to 12 and optionally (c) a hydrophilic surfactant are eminently suitable for finishing, in particular softening, fibrous material.

50 Claims, No Drawings

MIXTURES OF AN ACYLATED POLYAMINE AND AN ALCOHOL-ETHER USEFUL FOR TEXTILE FINISHING

The present invention relates to water-dilutable compositions which are suitable for finishing fibrous materials.

According to the invention, there is provided a water-dilutable mixture of (a) an acylated polyamine derivative selected from the group consisting of:

1. a polyamine acylated by introduction of at least one radical of a $C_{12-24}$-fatty acid and oxyalkylated,
2. an alkylated derivative of 1.,
3. a quaternated derivative of 1 or 2,
4. a protonated derivative of 1., 2. or 3., or a mixture thereof and (b) an alcohol-ether of the average formula $$R—O—(CH_2—CH_2—O)_nH \quad (I),$$

wherein R is $C_{1-4}$-alkyl and n is a number from 3 to 12.

The acylated polyamines in (a) are essentially aminoamides, and are preferably derived from an aliphatic polyamine, particularly containing at least three hydrogen atoms bound to amino nitrogen atoms. Suitable polyamines include:

polymethylene diamines comprising 2 to 6 methylene groups, preferably ethylene diamine, propylene diamine and hexamethylene diamine;

β-(β'-hydroxyethylamino)-ethylamine or β-(β'-hydroxypropylamino)-ethylamine, and poly-$C_2$- and/or $C_3$-alkylene polyamines containing from 3 to 5 amino groups, advantageously triethylenetetramine, dipropylene triamine, diethylene triamine and N-(β-aminoethyl)-N-(γ-aminopropyl)amine, the dialkylene triamines being preferred, particularly diethylene triamine and the N-aminoethyl-N-aminopropyl amine.

The fatty acids, from which the acyl radicals in (a) derive, are preferably $C_{16-22}$ fatty acids, the fatty radical thereof being saturated or unsaturated, in the latter case preferably monoethylenically unsaturated. Examples of suitable fatty acids are saturated fatty acids such as behenic, stearic or palmitic acid, and unsaturated fatty acids such as palmitoleic, oleic or erucic acid. The fatty acids can also be used as technical fatty acid mixtures. Most preferred fatty acids are oleic and stearic acids, optionally of technical grade.

Component (a) is preferably derived from a polyamine containing more than two basic nitrogen atoms. By basic nitrogen is meant a nitrogen protonatable under mild conditions. Component (a) advantageously contains an average of 1.5 to 2.5, preferably from 1.7 to 2.2 acyl radicals derived from the above mentioned fatty acids per molecule. More preferably at least 50 mole %, preferably 60–90 mole %, particularly 70–90 mole % of the acyl radicals present in component (a) are monoethylenically unsaturated acyl radicals, the reminder being saturated acyl radicals. A particular sub-group of components (a) is that in which at most 80 mole %, advantageously 70 to 80 mole %, preferably 72 to 78 mole % of the acyl radicals are monoethylenically unsaturated, the remainder being saturated acyl radicals. On average, at least one mole, preferably 1.1 mole, particularly 1.3 mole and at most 2 moles, preferably 1.8 moles, particularly 1.6 moles monoethylenically unsaturated acyl radicals and at least 0.2 moles, advantageously 0.3 to 1.0, preferably 0.3 to 0.6, particularly at least 0.4 moles saturated acyl radicals are introduced per mole of polyamine, particularly dialkylene triamine. The term "acyl group" is used herein in the limited sense of an alkyl- or alkenylcarbonyl group.

As already indicated, component (a) is also oxyalkylated; component (a) contains at least one alkyleneoxy group, preferably 1–4 alkyleneoxy groups, more preferably 1–1.5 alkyleneoxy groups per molecule. Preferred alkyleneoxy groups are ethyleneoxy and/or propyleneoxy, ethyleneoxy being particularly preferred. Advantageously, the acylated polyamine is oxyalkylated to such an extent that at least one basic nitrogen atom, preferably each basic nitrogen atom present in the molecule is oxyalkylated.

Component (a) may optionally be further alkylated, preferably by introduction of $C_{1-4}$alkyl or benzyl, particularly methyl or ethyl on the basic nitrogen atom or atoms present in component (a).

Furthermore, component (a) may also be quaternated. When component (a) is quaternated, it preferably contains at least 0.7, preferably at least 0.9 quaternary ammonium groups per molecule. The radical introduced by quaternization is advantageously a $C_{1-4}$alkyl group, preferably methyl or ethyl.

Component (a) may optionally be protonated, in particular as described below.

Component (a) can be prepared according to known methods. For the acylation, it may be advantageous to react the polyamine with a fatty acid as indicated or with a functional derivative thereof, for example an anhydride, acid halide, preferably acid chloride or bromide, or ester, advantageously methyl or ethyl ester. The acylation using a fatty acid, fatty acid anhydride or fatty acid ester may advantageously be carried out in the absence of a solvent with elimination of water or alcohol under evaporation or distillation, in particular at a temperature in the range of from 70° to 180° C., preferably 100° to 160° C., optionally under vacuum. Acylation using an acid halide may advantageously be effected under dehydrohalogenation conditions, for example in an aqueous or aqueous/organic medium, at a temperature ranging from room temperature to the boil, optionally in the presence of an inorganic base. Preferably, however, the acylation is performed without addition of water or solvent. Preferred components (a) contain both saturated and unsaturated fatty acid radicals. For the production of these the different acylating agents in particular the different fatty acids may be reacted with the amines in admixture with each other (e.g. as technical mixtures) or sequentially.

The reaction of the acylated polyamine with the alkylene oxide may advantageously be carried out in the absence of water, and with heating, preferably at a temperature from 80° to 120° C. When polyoxyalkylation is desired, it may be advantageous to use a catalyst, for example sodium hydroxide. Preferably oxyalkylation is carried out only at free basic amino groups which remain available.

The alkylation or quaternization is preferably effected by reacting with the corresponding alkyl or benzyl halide (e.g. chloride, bromide, iodide), or with an alkyl sulphate. The reaction may be performed at a temperature from 30° to 90° C. depending on the alkylating or quaternizing agent used. The alkyl halides and sulphates, in particular methyl and ethyl halides and sulphates, are preferred for quaternization.

Conventional acids, preferably low molecular aliphatic carboxylic acids, may be employed for protonation; in particular aliphatic carboxylic acids with 1 to 5 carbon atoms, preferably formic, acetic or lactic acid.

In the compounds of formula I used as component (b), R may be methyl, ethyl, n-propyl, isopropyl, sec-, t-iso- or n-butyl, butyl and particularly n-butyl being preferred. n is an average number and need not be integral; n is preferably a number from 3.5 to 8, particularly 3.5 to 6, especially 4 to 6; more preferably the number of ethylenoxy units in component (b) is far unitary (i.e. the gaussian distribution is narrowest). Component (b) is preferably essentially free from lower oxyethylated alcohols. Preferred compounds of formula I as component (b) are tetra-, penta- or hexaethylene glycol monoalkyl ethers.

The mixture of the invention advantageously contains per 100 parts by weight of component (a), from 12 to 50, preferably 25 to 40 parts by weight of component (b). Compositions comprising a mixture of (a) and (b) as disclosed are also part of the invention.

In addition to components (a) and (b), a minor amount of one or more additives suitable e.g. to improve the stability to storage or the conditions of use may be admixed to the above mixtures. Preferably such a further additive is (c) a hydrophilic surfactant.

The above mixtures of (a), (b) and optionally (c) are essentially water-free and preferably liquid. A particular aspect of the invention are liquid, water-dilutable, essentially water-free compositions consisting essentially of (a), (b) and (c) as defined herein.

The hydrophilic surfactant (c) may be a non-ionic or cationic protective colloid, preferably a protective colloid whose molecule contains a lipophilic aliphatic residue having 9–24 carbon atoms and at least one polyalkylene glycol chain containing at least 7 ethyleneoxy groups and optionally propyleneoxy groups, or is a copolymer of ethylene oxide and propylene oxide. The ethyleneoxy groups present in component (c) advantageously amount to at least 40 mole %, preferably to at least 70 mole %, more preferably to 100 mole % of the total alkyleneoxy groups of the molecule. Specific types of hydrophilic surfactants (c) include:

ethylene oxide/propylene oxide copolymers preferably those in which preferably the number of ethylenoxy units prevails;

addition products of ethylene oxide and optionally propylene oxide to fatty alcohols or fatty acid amides or addition products of ethylene oxide to fatty acid alkanol amides, particularly the addition products of 7–70 moles ethylene oxide and optionally of a smaller amount of propylene oxide to an aliphatic primary or secondary $C_{12-22}$alcohol, e.g. oleyl, stearyl, tallow fatty, cetyl, technical grade stearyl alcohol, or the addition products of 10–30 moles ethylene oxide to 1 mole $C_{12-18}$ fatty acid amide;

polyethylene glycol esters of long chain fatty acids;

addition products of ethylene oxide and optionally propylene oxide to partial fatty acid esters of polyols, e.g. glycerol, mannitol, sorbitol or pentaerythritol, or their cyclic ethers, and to hydroxy groups-containing fatty acid triglycerides, for example addition products of ethylene oxide to sorbitol $C_{14-18}$ fatty acid mono- or diesters or addition products of ethylene oxide and optionally propylene oxide to castor oil, particularly the addition products of 20–100 moles ethylene oxide and propylene oxide in optionally an amount corresponding to a number of units of up to 1.5 times the number of ethylene oxide units to 1 mole triglyceride;

addition products of ethylene oxide and optionally of propylene oxide to monoalkyl or dialkylphenols, e.g. mono- or dinonyl-phenol, iso-octylphenol or ditert-.butylphenol, particularly the addition products of 7–40 moles ethylene oxide phenols substituted by one or two $C_{4-9}$alkyl groups;

addition products of ethylene oxide and optionally propylene oxide to fatty amines e.g. oleylamine or technical grade stearyl amine, or fatty amino-$C_{2-6}$alkyleneamines, e.g. stearylaminopropylamine, optionally of technical grade, particularly the addition products of 10–40 moles ethylene oxide to $C_{12-18}$, especially $C_{18}$ fatty amines, and addition products of 10–50 moles ethylene oxide and optionally propylene oxide to 1 mole $C_{14-19}$ fatty amino$C_{2-6}$alkylene amines, preferably $C_{14-18}$ fatty aminopropylene amines, the number of ethylene oxide units representing at least 50 mole %;

addition products of ethylene oxide to condensation products of mono-$C_{4-9}$-alkyl and/or di-($C_{4-9}$alkyl)-phenols, e.g. monononylphenol, dinonylphenol, isooctylphenol or ditert.butylphenol with formaldehyde such as the so-called "Novolacs", and containing 20 to 100 ethylene oxide units per hydroxy group.

The oxyethylation degree of component (c) is advantageously such as it exhibits an HLB-value significantly higher than 8. Preferably component (c) has a calculated HLB-value of 10–20, particularly 12–18 and advantageously an HLB-value determined by NMR of at least 12. When component (c) contains propylene oxide units, the number of such units may be higher then that of ethylene oxide units as indicated above, (e.g. up to twice the number of ethylene-oxy units), however, it should not lower the HLB-value below the indicated values.

The composition of the invention advantageously contains component (c) in a low weight ratio to the total weight of (a) and (b). The amount of component (c) is preferably 2–20, more preferably 2.5–10 parts by weight per 100 parts by weight of the sum (a)+(b).

The compositions of the invention are preferably water-free or have a very low water content; an amount up to 1% by weight, preferably up to 0.5% by weight based on the total weight of (a)+(b)+(c) may be tolerable. The composition of the invention may further contain a reducing agent (protection against oxidation), e.g. glucose or a salt such as alkali metal bisulphite, and/or an acid as indicated above. Such an acid may serve to the protonation of non-quaternized basic amino groups present in component (a). When component (a) is quaternized, the acid may also be added to the composition advantageously in an amount of up to 10 mole %. An acid for protonation of non-quaternized amino groups in (a) may advantageously be added after the addition of (b) and optionally (c). The composition of the invention may also contain preserving agents, for example fungicides and/or bactericides, e.g. in a concentration of 0.05 to 0.4% based on the total weight of the composition.

The so composed preparations are ready of use.

The compositions of the invention have a good storage stability at the usual temperature ranges as well as under conditions of frost or heat. They exhibit a good flowability and are easy to manipulate even at a low temperature where they remain pourable and pumpable. The compositions of the invention in which component (a) has a high content of unsaturated fatty acid residue—as described above—have particularly interesting flowability properties. The compositions of the invention remain stable to temperature variations and can be subjected to elevated temperatures, e.g. as occurring in stenter drying or synthetic resin finishing, whereby there is substantially no gas development (except for any steam).

The compositions of the invention have softening properties and are eminently suitable as finishing agents for fibrous substrates, particularly as softening agents.

Accordingly, the present invention also provides a process for the treatment of a fibrous substrate comprising applying to the substrate an aqueous composition as disclosed in particular below.

Suitable fibrous substrates include natural, synthetic or semi-synthetic and blended fibrous materials, for example natural or synthetic polyamides such as wool, silk, polyamide 6, polyamide 66, polyamide 11, polyamide 46, Qiana or aromatic polyamides, polyester, polyacrylonitrile, natural or regenerated cellulose such as cotton, linen, jute, hemp, cellulose acetate or viscose, polyurethanes and their mixtures, the acrylic, polyamide and especially the cellulosic fibres and their mixtures being preferred. The fibrous substrate may be in any conventional form, for example as loose fibres, threads, yarns, hanks, spools, non-wovens, paper, felts, wovens, knitted goods, velvet, tufted goods, carpets or semi- or fully finished articles, preferably as flocks, cross-bobbins, flat surface textiles or tubular goods.

For use, the composition of the invention is advantageously diluted with water. The finishing of the substrate with the composition is preferably performed in an aqueous medium, the composition being applied by any conventional textile finishing technique, for instance by impregnation such as padding, applying with a doctor, spraying, immersing, pouring or foam processes, or by exhaustion from a long or short liquor to goods ratio (e.g. in the vat, in the winch back, in jet-dyeing machines, by short liquor-to-goods ratio processes or in any other apparatus suitable for exhaust dyeing). After application, the substrate may be dried, optionally after an intermediary steaming or fixation.

The composition of the invention is advantageously used in the form of a concentrated solution or dispersion, e.g. a stock solution or dispersion, containing advantageously component (a) in a concentration $\leqq 15\%$ by weight, preferably $\leqq 7.5\%$ by weight.

The finishing of the fibrous substrates with the composition of the invention is a non-permanent treatment, which is advantageously carried out as the last finishing step. It is convenient to carry out the treatment in the same apparatus as that used for an earlier finishing process. Preferably the composition of the invention is applied by exhaustion techniques, preferably as used in a jet dyeing machine or for cross-bobbins, or by spraying, for example with a disk sprayer, a nebulizer—e.g. for flock—or by a minimum application technique ("Minimal-Auftrag-Technik").

The concentration of the composition of the invention on the substrate advantageously lies between 0.05 and 2% by weight of the total (a) +(b), preferably 0.1–0.6%, based on the weight of the substrate.

The treatment process may advantageously be carried out at a pH between 3.5 to 9, the lower pH values, preferably 3.5 to 8, particularly 4.5 to 8 being preferred for the treatment of a cellulosic fibrous substrate and the higher pH values, preferably 7 to 9 for the treatment of synthetic fibres. The treatment liquor may advantageously be applied at a temperature from 15° to 70° C., preferably 15° to 50° C. when it is applied by impregnation. The subsequent drying and/or any post-treatment may be effected at any suitable temperature; the treated substrate may for example be dried at a temperature exceeding 70° C., particularly at a temperature up to 140° C., e.g. 102°–130° C., for instance on a stenter. The treated substrate may be submitted to a heat treatment, particularly a fixation treatment when the fibrous substrate comprises synthetic fibres; such a heat treatment may be effected at a temperature below 200° C., for example within the range 150°–190° C.

According to the invention, the composition may also be applied simultaneously with a resin finish which is advantageously curable at a temperature of from 150°–190° C., preferably 150°–170° C. Suitable resin finishes are any resin finishes conventional for the finishing of textiles in particular cellulosic material, preferably, those which on reaction with a catalyst give a finishing having a non-ionic or basic character, particularly those used for the finishing of textiles, especially cellulosic fibrous substrates. Such finishes are known and disclosed e.g. by M. W. Ranney in "Crease-Proofing Textiles" (*Textile Processing Review*, No. 2, NDC, 1970), by Chwala and Anger im "Handbuch der Textilhilfsmittel" (Verlag Chemie, Weinheim, New York, 1977, pages 446 to 466) and in U.S. Pat. Nos. 4,475,918, 4,439,203, 4,511,707, 4,452,606, 4,443,223 and 4,410,652.

The fibrous substrates exhibit after the treatment with the composition of the invention, good hydrophilic properties, a good compatibility with the subsequent dyeing and more particularly an excellent soft handle which improves the working up of the substrate, especially the manufacture of ready-made clothing.

The following Examples, in which all parts and percentages are by weight, illustrate the invention. The temperatures are in degrees Centigrade.

EXAMPLE 1

719.1 Parts oleic acid and 121.5 parts technical grade stearic acid (acid number=208) are heated to 100° and reacted with 154.5 parts diethylene triamine. The temperature is then slowly raised to 150° and maintained for 7 hours, of which 5 hours are under vacuum. Thereafter, 66 parts ethylene oxide are added at 100°–105°. After 3 hours reaction, the resulting mixture is cooled to 50° and then quaternized with 179.5 parts dimethyl sulphate. After stirring for 1 hour, there are added to the reaction mixture while stirring, 65.9 parts of the addition product of 32 moles ethylene oxide to 1 mole castor oil (triglyceride), 382.4 parts tetraethylene glycol monobutyl ether, 6.6 parts acetic acid and 6.6 parts of a 40% sodium bisulphite solution.

The resulting product is readily flowable, pourable and pumpable. It has a viscosity of 420 cps (Brookfield, spindle Nr. 3) at 25° and of 3400 cps at 0°. It also remains pourable at 0°.

EXAMPLE 2

2 Parts of the product obtained in Example 1 are stirred into 18 parts water. After a short while, there is obtained a finely distributed dispersion.

EXAMPLE 3

154.5 Parts diethylene triamine are heated to 100° and reacted with 202.5 parts stearyl acid added portionwise.

After 2 hours reaction at 140°, there are added to the reaction mixture 634.5 parts oleic acid and the resulting mixture is further heated at 150° for 4 hours without and for 3 hours with vacuum.

Thereafter, 66 parts ethylene oxide are added followed by quaternation with 179.5 parts dimethyl sulphate as disclosed in Example 1. 65.9 parts of the addition product of 32 moles ethylene oxide to 1 mole castor oil, 382.4 parts tetraethylene glycol monobutyl ether, 6.6 parts acetic acid and 6.6 parts of a 40% sodium bisulphite solution are then added to the reaction mixture. 1648 Parts of a liquid, pumpable composition are obtained.

EXAMPLE 4

By following the procedure of Example 3 but using 121.5 parts of technical grade stearic acid (acid number=208) and 719.1 parts oleic acid instead of the 202.5 parts stearic acid and 634.5 parts oleic acid, respectively, a composition according to the invention is obtained.

Application Example A 0.03 Parts of the composition of Example 1 diluted in 0.5 parts water are added to a bath of 75–100 parts water containing 5 parts cotton fabric and adjusted with acetic acid to pH 5. The bath is then heated to 40°–45° within 10 minutes and further maintained at this temperature for 20 minutes. Without rinsing, the fabric is then hydroextracted and then air-dried. The resulting fabric has a soft handle.

Application Example B 0.9 kg of the composition of Example 3, diluted in 100 kg water are introduced at 40° within 10 minutes in a jet dyeing machine (THEN-FLOW KFA 300) containing 350 kg cotton knitted goods at pH 7.5. The goods to liquor ratio is 1:8. After further 15 minutes treatment, the goods are discharged, hydroextracted and dried on a stenter at 130°. The resulting goods exhibit a soft handle.

Application Example C

A cotton/polyester (70/30) blended fabric is padded at room temperature at a pick-up of 80% with 5 g/l of the composition of Example 3 and dried on a stenter at 130°.

Application Example D

A 80% wet cotton terry cloth is continuously sprayed at 20° in a WEKO disk sprayer with a solution containing 20 g/l of the composition of Example 1. The pick-up is 30% based on the dry weight. The cloth is then dried on a stenter at 130°. The treated cloth has a soft handle and simultaneously a good rewettability. There are no dry deposits on the spraying disk.

Application Example E 1 kg polyacrylonitrile yarn wound on cross-bobbins are treated at 20° with a liquor containing 3 g of the composition of Example 3 pre-diluted with 30 g water, and adjusted to pH 8.5 with sodium bicarbonate. The liquor to goods ratio is 8:1. After a treatment of 15 minutes, the liquor is discharged and the cross-bobbins are dried at 90°. The resulting yarn exhibits a soft handle.

Application Example F

A dry furnishing cotton fabric is treated at 20° in a Triatex MA machine (MA=minimum application) with a liquor containing 12 g/l of the composition of Example 1. The speed of the fabric is 80 m/min and the liquor is applied at a ratio of 40% based on the weight of the fabric. Thereafter the impregnated furnishing fabric is dried at 130° on a stenter at a high speed. The resulting fabric exhibits a notable soft handle.

Application Examples G to L

The procedures of Examples A to F are repeated but replacing the composition of Example 1 or 3 by the composition of Example 4.

I claim:

1. A water-dilutable mixture of (a) an acylated polyamine derivative selected from the group consisting of:

1. a polyamine acylated by introduction of at least one radical of a $C_{12-24}$-fatty acid and oxyalkylated,
2. an alkylated derivative of 1.,
3. a quaternated derivative of 1. or 2.,
4. a protonated derivative of 1., 2. or 3., or a mixture thereof and (b) an alcohol-ether of the average formula $$R—O—(CH_2—CH_2—O)_nH \quad (I),$$

wherein R is $C_{1-4}$-alkyl and n is a number from 3 to 12.

2. A composition according to claim 1 consisting essentially of (a) and (b) together with (c) a hydrophilic surfactant.

3. A composition according to claim 2, which is essentially water-free.

4. A composition according to claim 1 in which (a) is a product obtained by acylating a triamine selected from the group consisting of diethylenetriamine and N-(β-aminoethyl)-N-(γ-aminopropyl)-amine to such a degree that on the average 1.5 to 2.5 acyl radicals of a $C_{16-22}$-fatty acid or of a mixture of such acids are introduced into the triamine, oxyethylating with 1 to 4 moles of ethylene oxide per mole of acylated triamine and optionally methylating, wherein methylation may have been carried out up to quaternization.

5. A composition according to claim 1 in which in component (b) n is 3.5 to 8.

6. A composition according to claim 1 containing 12 to 50 parts by weight of (b) per 100 parts by weight of (a).

7. A composition according to claim 2 in which the weight ratio (c)/is in the range of 2/100 to 20/100.

8. A composition according to claim 1 in which (a)1 is a product which contains an average of 1.5 to 2.5 acyl radicals per molecule and which is obtained by introducing, on average, 1 to 2 moles of monoethylenically unsaturated acyl radical per mole of polyamine.

9. A composition according to claim 1 wherein:

(a)1 is a product of acylating a polyamine selected from the group consisting of polymethylene diamines comprising 2 to 6 methylene groups, β-(β'-hydroxyethylamino)-ethylamine, β-(β'-hydroxypropylamino)-ethylamine and poly-$C_2$ and/or $C_3$-alkylene polyamines containing 3 to 5 amino groups with a $C_{16-22}$ fatty acid or mixture thereof and oxyalkylating the resulting acylated polyamine so as to introduce 1 to 4 alkyleneoxy groups selected from the group consisting of ethyleneoxy and propyleneoxy, (a)2 is a product of alkylating (a)1 by introduction of $C_{1-4}$alkyl or benzyl on the basic nitrogen atom(s) present in (a)1, (a)3 is a product of quaternizing (a)1 or (a)2 by introducing a $C_{1-4}$alkyl group, and (a)4 is a product of protonating (a)1, (a)2 or (a)3 with an acid.

10. A composition according to claim 8 containing 12 to 50 parts by weight of (b) per 100 parts by weight of (a) and wherein, in component (b), n is 3.5 to 8.

11. A composition according to claim 9 wherein, in (b), n is 3.5 to 8.

12. A composition according to claim 10 which contains (c) a hydrophilic surfactant having an HLB value of 10 to 20.

13. A composition according to claim 10 wherein, in (b), R is butyl.

14. A composition according to claim 11 wherein, in (b), R is butyl.

15. A composition according to claim 11 in which (a) 1 is a product which contains an average of 1.5 to 2.5 acyl radicals per molecule and which is obtained by introducing, on average, 1 to 2 moles of monoethylenically unsaturated acyl radical per mole of polyamine.

16. A composition according to claim 11 which optionally further contains (c) a hydrophilic surfactant and which contains no more than 1% water based on the total weight of (a)+(b)+(c).

17. A composition according to claim 15 which optionally further contains (c) a hydrophilic surfactant and which contains no more than 1% water based on the total weight of (a)+(b)+(c).

18. A composition according to claim 16 which contains 12 to 50 parts by weight of (b) per 100 parts by weight of (a).

19. A composition according to claim 16 which contains (c) a hydrophilic surfactant having an HLB value of 10 to 20.

20. A composition according to claim 17 which contains 12 to 50 parts by weight of (b) per 100 parts by weight of (a).

21. A composition according to claim 17 which contains (c) a hydrophilic surfactant having an HLB value of 10 to 20.

22. A composition according to claim 19 which contains 12 to 50 parts by weight of (b) per 100 parts by weight of (a) and 2 to 20 parts by weight of (c) per 100 parts by weight of (a)+(b).

23. A composition according to claim 21 which contains 12 to 50 parts by weight of (b) per 100 parts by weight of (a) and 2 to 20 parts by weight of (c) per 100 parts by weight of (a)+(b).

24. A composition according to claim 22 wherein, in (b), R is butyl.

25. A composition according to claim 23 wherein, in (b), R is butyl.

26. A composition according to claim 10 wherein the polyamine contains more than two basic nitrogens and also contains at least three hydrogens bound to amino nitrogen atoms.

27. A composition according to claim 22 wherein the polyamine contains more than two basic nitrogens and also contains at least three hydrogens bound to amino nitrogen atoms.

28. An aqueous composition containing (a) an acylated polyamine derivative selected from the group consisting of:

(1) a polyamine acylated by introduction of at least one radical of a $C_{12-24}$-fatty acid and oxyalkylated, (2) an alkylated derivative of (1), (3) a quaternated derivative of (1) or (2), (4) a protonated derivative of (1), (2) or (3), or a mixture thereof and (b) an alcohol-ether of the average formula $$R-O-(CH_2-CH_2-O)_nH \quad (I),$$

wherein R is $C_{1-4}$alkyl and n is a number from 3 to 12, in aqueous solution or dispersion.

29. An aqueous composition according to claim 28, which further contains (c) a hydrophilic surfactant.

30. An aqueous composition comprising a mixture according to claim 10 in water.

31. An aqueous composition comprising a mixture according to claim 15 in water.

32. An aqueous composition prepared by diluting a composition according to claim 11 with water.

33. An aqueous composition prepared by diluting a composition according to claim 20 with water.

34. An aqueous composition prepared by diluting a composition according to claim 23 with water.

35. An aqueous composition prepared by diluting a composition according to claim 25 with water.

36. A process for finishing fibrous material which comprises applying to the material an aqueous composition according to claim 28.

37. A process for finishing fibrous material which comprises applying to the material an aqueous composition according to claim 29.

38. A process for finishing fibrous material which comprises applying to the material an aqueous composition according to claim 30.

39. A process for finishing fibrous material which comprises applying to the material an aqueous composition according to claim 31.

40. A process for finishing fibrous material which comprises applying to the material an aqueous composition according to claim 32.

41. A process for finishing fibrous material which comprises applying to the material an aqueous composition according to claim 33.

42. A process for finishing fibrous material which comprises applying to the material an aqueous composition according to claim 34.

43. A process for finishing fibrous material which comprises applying to the material an aqueous composition according to claim 35.

44. A process according to claim 31 which comprises applying the aqueous composition by an impregnation or exhaust method and drying the treated material at a temperature above 70° C.

45. A process according to claim 36 which comprises applying a resin finish to the fibrous material simultaneously with the aqueous composition.

46. A process according to claim 36 which comprises applying the aqueous composition to fibrous material selected from the group consisting of polyamide, polyester, polyacrylonitrile, cellulose, polyurethane and mixtures thereof in an amount sufficient to give a concentration of (a) +(b) on the material which is in the range 0.05 to 2% based on the weight of the material.

47. A process according to claim 43 which comprises applying the aqueous composition to fibrous material selected from the group consisting of polyamide, polyester, polyacrylonitrile, cellulose, polyurethane and mixtures thereof in an amount sufficient to give a concentration of (a) +(b) on the material which is in the range 0.05 to 2% based on the weight of the material.

48. A process according to claim 44 which comprises spraying the aqueous composition on the fibrous material and drying at a temperature up to 140° C.

49. Fibrous material finished by a process according to claim 31.

50. Fibrous material whenever finished by the process according to claim 38.

* * * * *